US007270379B2

(12) United States Patent
Stehney

(10) Patent No.: US 7,270,379 B2
(45) **Date of Patent: *Sep. 18, 2007**

(54) TOOL HOLDER BLOCK AND SLEEVE RETAINED THEREIN BY INTERFERENCE FIT

(75) Inventor: Stephen C. Stehney, Abingdon, VA (US)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 11/525,089

(22) Filed: Sep. 22, 2006

(65) Prior Publication Data

US 2007/0013224 A1 Jan. 18, 2007

Related U.S. Application Data

(63) Continuation of application No. 11/061,551, filed on Feb. 18, 2005.

(51) Int. Cl.
*E21C 35/18* (2006.01)

(52) U.S. Cl. ..... 299/104; 299/107

(58) Field of Classification Search ..... 299/104, 299/107, 110, 95

See application file for complete search history.

(56) References Cited

U.S. PATENT DOCUMENTS

| | | | | |
|---|---|---|---|---|
| 3,143,177 | A | 8/1964 | Galorneau et al. | |
| 3,397,012 | A | 8/1968 | Krekeler | |
| 3,499,685 | A | 3/1970 | Kniff | |
| 3,749,190 | A | 7/1973 | Shipman | |
| 3,941,495 | A * | 3/1976 | Duncan | 403/267 |
| 4,201,421 | A | 5/1980 | Den Besten et al. | |
| 4,247,147 | A | 1/1981 | Rettkowski | |
| 4,247,150 | A | 1/1981 | Wrulich et al. | |
| 4,299,424 | A | 11/1981 | LeBegue et al. | |
| 4,333,687 | A | 6/1982 | Barnstorf | |
| 4,337,980 | A * | 7/1982 | Krekeler | 299/102 |
| 4,456,306 | A | 6/1984 | Wrulich et al. | |
| 4,537,448 | A * | 8/1985 | Ketterer | 299/81.2 |
| 4,542,942 | A | 9/1985 | Zitz et al. | |
| 4,575,156 | A | 3/1986 | Hunter et al. | |
| 4,632,463 | A | 12/1986 | Sterwerf, Jr. | |

(Continued)

FOREIGN PATENT DOCUMENTS

| | | |
|---|---|---|
| DE | 33 07 910 | 9/1984 |

(Continued)

*Primary Examiner*—John Kreck
(74) *Attorney, Agent, or Firm*—Drinker Biddle & Reath LLP

(57) ABSTRACT

A hollow sleeve is mounted in a hole of a holder block to receive a rotary cutter bit. The sleeve includes a front flange and a shank extending rearwardly from the front flange and defining a longitudinal axis. The shank includes an outer periphery having a radially stepped configuration, wherein an outer surface of the shank includes a plurality of axially adjacent surface sections that become successively smaller in cross-section in a direction away from the flange. Each surface section occupies one-third of the hole length. Each surface section has longitudinally spaced front and rear ends, wherein a portion of each surface section situated between its front and rear ends is spaced farther from the axis than are the front and rear ends. Each surface section has a generally longitudinally extending groove formed therein.

28 Claims, 4 Drawing Sheets

U.S. PATENT DOCUMENTS

| | | | | |
|---|---|---|---|---|
| 4,684,176 | A | | 8/1987 | Den Besten et al. |
| 4,728,153 | A | | 3/1988 | Ojanen et al. |
| 4,836,614 | A | | 6/1989 | Ojanen |
| 4,850,649 | A | | 7/1989 | Beach et al. |
| 4,875,532 | A | | 10/1989 | Langford, Jr. |
| 4,921,310 | A | | 5/1990 | Hedlund et al. |
| 4,978,173 | A | | 12/1990 | Rothkegel |
| 5,067,775 | A | | 11/1991 | D'Angelo |
| 5,088,797 | A | | 2/1992 | O'Neill |
| 5,106,166 | A | | 4/1992 | O'Neill |
| 5,302,005 | A | | 4/1994 | O'Neill |
| 5,685,381 | A | | 11/1997 | Kloppers et al. |
| 5,725,283 | A | | 3/1998 | O'Neill |
| 5,738,415 | A | | 4/1998 | Parott |
| 5,769,505 | A | | 6/1998 | Siddle |
| D422,127 | S | * | 3/2000 | Jacques et al. ..... D34/39 |
| 6,113,195 | A | * | 9/2000 | Mercier et al. ..... 299/104 |
| 6,176,552 | B1 | | 1/2001 | Topka, Jr. et al. |
| D448,909 | S | * | 10/2001 | Friesen et al. ..... D34/39 |
| 6,371,567 | B1 | | 4/2002 | Sollami |
| 6,623,084 | B1 | | 9/2003 | Wasyleczko |
| 6,712,431 | B1 | | 3/2004 | Bosch et al. |
| 6,786,557 | B2 | | 9/2004 | Montgomery, Jr. |
| 6,854,810 | B2 | | 2/2005 | Montgomery, Jr. |
| 2003/0015907 | A1 | | 1/2003 | Sollami |

FOREIGN PATENT DOCUMENTS

| | | |
|---|---|---|
| DE | 3413334 A | 11/1984 |
| DE | 36 30 443 | 3/1988 |
| GB | 1 218 308 | 1/1971 |
| GB | 2 071 184 | 9/1981 |
| GB | 2 151 284 | 7/1985 |
| GB | 36 30 443 | 3/1988 |
| GB | 2 230 801 | 10/1990 |
| GB | 2 273 513 | 6/1994 |
| GB | 2 285 464 | 7/1995 |
| GB | 2 327 446 | 1/1999 |
| GB | 2 369 137 | 5/2002 |
| WO | WO 00/34626 | 6/2000 |

* cited by examiner

TOOL HOLDER BLOCK AND SLEEVE RETAINED THEREIN BY INTERFERENCE FIT

RELATED APPLICATION DATA

This application is a continuation application of U.S. Application Ser. No. 11/061,551, filed Feb. 18, 2005, the entire disclosure of which is considered as being part of the disclosure of the present application and is hereby incorporated by reference.

BACKGROUND OF THE INVENTION

The present invention relates to cutting bit holders, especially to holders which support pressed-in replaceable sleeves that carry rotatable cutting bits.

Drum-type cutters are conventional in the mining and road-working industries for example, wherein cutter bits are mounted on a drum which rotates about a horizontal axis. Such cutters can be used to cut through minerals in a mine, or to rip up asphalt or concrete from a roadway. The cutter bits, which are carried by holder blocks welded to the outer surface of the drum, are rotatable about their own longitudinal axes so as to be self sharpening. During a cutting operation, not only do the bits tend to wear, but the holder blocks wear as well. That is, the area of the holder block that surrounds the bit-receiving hole wears due to abrasion thereof by the materials being cut. It will be appreciated that the need to replace the welded-on holder blocks results in a serious expenditure of time and money.

To minimize that problem, it has been proposed to mount each cutter bit in a replaceable hollow sleeve which is inserted into a respective holder block. The sleeve includes a flange that overlies the area of the holder block that surrounds the mouth of the bit-receiving hole, and thereby shields the holder block from appreciable wear. Instead, the sleeves become worn and are replaced when necessary.

One type of such sleeve 10, disclosed in U.S. Pat. No. 5,106,166 and depicted herein in FIG. 1, includes a cylindrical shank 12 that is received in a cylindrical open-ended hole 14 of a holder block 16 that is to be mounted on any suitable carrier 17, such as a rotary drum or an endless chain (e.g., trench digger), or even a non-rotatable carrier. The sleeve is hollow, in order to receive a cutter bit 18 that is mounted in the sleeve for rotation relative thereto by a retainer, e.g., a split sleeve (not shown), that fits within a groove 20 of the bit. The sleeve 10 is held within the hole 14 by a retainer, e.g., a split-ring retainer clip 22 which fits in an external groove 24 of the shank 12. In order to prevent the sleeve from rotating within the holder block, and thus wearing the surface of the hole 14, a key 26 is disposed within aligned recesses formed in a front flange 28 of the sleeve and the holder 16, respectively.

In order to enhance the securement of the sleeve, it has been proposed to mount the sleeve by an interference fit, or press fit. One known type of interference fit comprises a long single cylindrical interference fit. Another type comprises a pair of short cylindrical (or conical) bands of interference fit having different respective cross-sectional sizes (e.g., see U.S. Pat. No. 5,302,005). The provision of such short bands of interference fit is intended to eliminate the need for separate retainers such as split-ring clips and anti-rotation keys. Nevertheless, some sleeves still become prematurely dislodged. Moreover, as the sleeve is being inserted, closed spaces are created between the short bands and the hole surface which can become filled with lubricating oil that is used to facilitate the installation of the sleeve. As the sleeve is advanced into the hole, the oil can become trapped and pressurized as the volume of the spaces diminishes, thereby tending to force the sleeve back out of the hole. As the drum rotates during a cutting operation, the cutting forces push the sleeve into the hole during a cutting phase, but then the pressurized oil pushes the sleeve out of the hole when the respective bit moves out of engagement with the material being cut. Such a reciprocating action of the sleeve can produce undesirable wear of the hole surface.

It would be desirable to ensure that the sleeve is not able to be pushed out of the hole by pressurized lubricating oil, as well as to maximize the forces holding the sleeve against axial and rotary movements within the hole in order to prevent dislodgement of the sleeve during operation.

SUMMARY OF THE INVENTION

At least some of the objects of the present invention are achieved by a hollow sleeve which is adapted to be mounted in a hole of a holder block to receive a cutter bit. The sleeve comprises a shank defining a longitudinal axis and including an outer periphery having at least one surface section which includes longitudinally spaced front and rear ends. A portion of the at least one surface section situated between the front and rear ends is spaced farther from the axis than are the front and rear ends. A center through-hole extends axially through the shank.

Preferably, the at least one surface section comprises a plurality of axially adjacent surface sections that become successively smaller in crosssection in a direction away from the front end.

Another aspect of the invention relates to the above described hollow sleeve in combination with a holder block in which the sleeve is received.

Yet another aspect of the invention relates to a hollow sleeve whose shank includes an outer periphery having a radially stepped configuration wherein the axially adjacent surface sections therein have a generally front-to-rear extending groove formed therein. Such a groove permits the escape of lubricating oil during installation of the sleeve. Preferably, the groove extends parallel to the axis.

Yet another aspect of the invention relates to a hollow sleeve whose shank includes an outer periphery having a radially stepped configuration defined by three surface sections, consisting of front, rear, and intermediate surface sections. Each surface section has a longitudinal length which is substantially equal to one third of a longitudinal distance from the front end of the front surface section to the rear end of the rear surface section. Such relatively long surface sections establish a particularly effective interference fit.

It is to be understood that both the foregoing general description and the following detailed description are exemplary and explanatory and are intended to provide further explanation of the invention as claimed.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DESCRIPTION OF PREFERRED EMBODIMENTS

Figure 1:
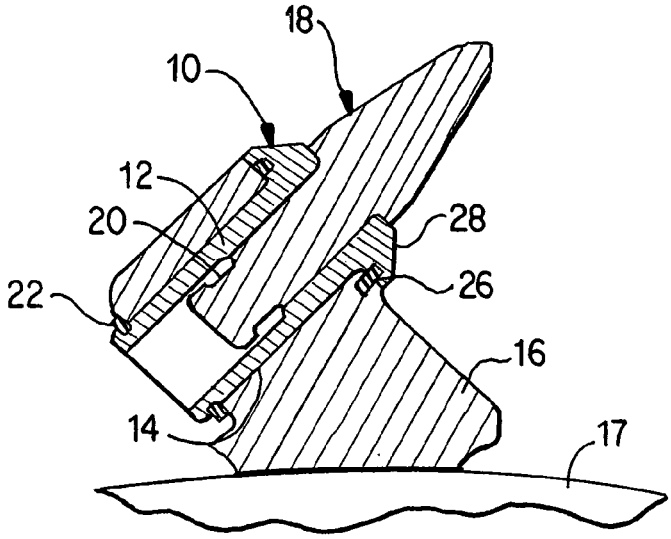
FIG. 1 PRIOR ART
FIG. 1 is a longitudinal sectional view through a prior art cutter assembly.
Figure 2:
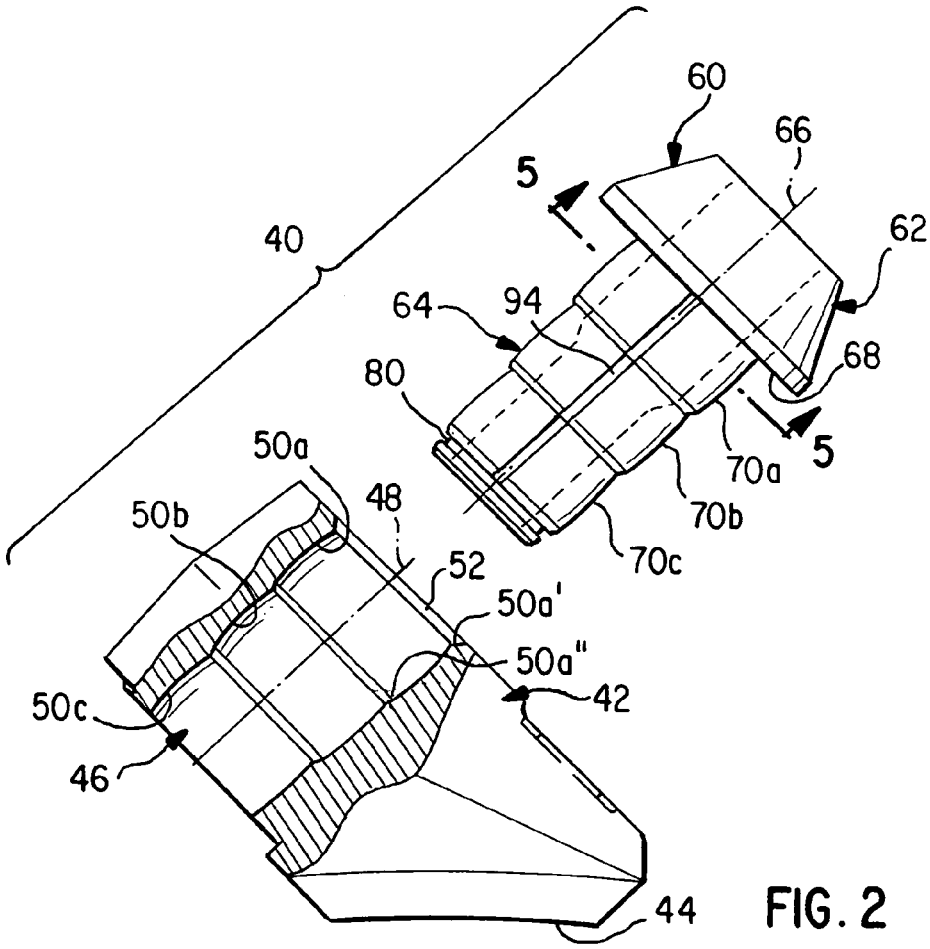
FIG. 2 is an exploded view of a holder block and sleeve according to the present invention.

Depicted in FIGS. 2-5 is a holder assembly adapted to mount a rotary cutter bit on any suitable carrier, such as a rotary drum, an endless chain (e.g., trench digger) or even a non-rotatable carrier. The holder assembly includes a holder block 42 having a curved surface 44 configured for engaging the outer periphery of a rotary drum. The block includes an open ended through-hole 46 which defines a longitudinal center axis 48. The hole 46 includes an inner surface of stepped configuration, wherein the surface includes a plurality of longitudinally adjacent surface sections 50*a*, 50*b*, and 50*c*, which become successively smaller in cross-section in a direction away from a front mouth 52 of the hole 46. Each of the surface sections 50*a-c* has longitudinally spaced front and rear ends, e.g., see the front and rear ends 50*a*′, 50*a*″ of the surface section 50*a* in FIG. 2, and corresponding front and rear ends 50*b*′, 50*b*″, 50*c*″, 50*c*″ of the other surface sections 50*b*, 50*c*.

The surface sections 50*a*-50*c* are neither cylindrical nor conical. Rather, they are configured wherein a portion of each surface section situated between its front and rear ends is spaced farther from the axis 48 than are the front and rear ends of such surface section. Thus, for example, with reference to FIG. 6, the distances d1 and d2, which represent the respective distances of the front and rear ends 50*c*′, 50*c*″ from the axis, are equal to one another and shorter by an amount X than the distance d3 between the axis and the surface section 50*c* at a location between (interjacent) the front and rear ends. Preferably, that relationship is achieved by making each of the surface sections 50*a*-50*c* of spherical curvature as indicated by the radius r for the surface section 50*a* in FIG. 6. The distance X is preferably about 0.0005 inches.

The curvatures of the spherical surface sections 50*a-c* are shown somewhat exaggeratedly in the drawings. For example, in a block in which the diameter d at the front end of the hole 46 is 2 ⅜ inches, the radius r for each of the surface sections could be about 391 inches. Shapes for the surface sections other than spherical are possible, such as elliptical or parabolic for example.

Figure 6:
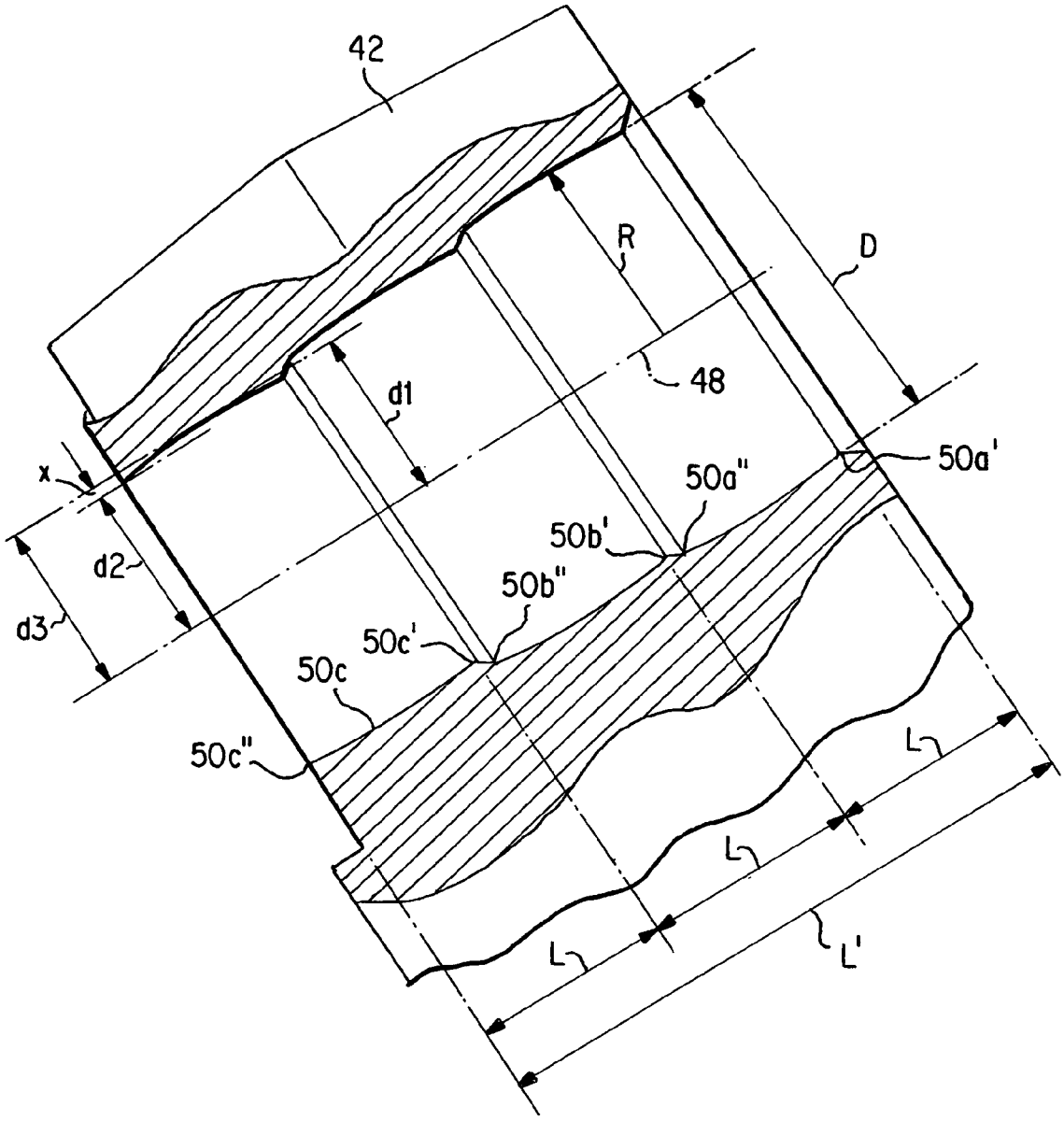
FIG. 6 is an enlarged cross-sectional view of the holder block.

The mouth 52 of the hole 46 is slightly chamfered as can be seen in FIG. 6 in order to facilitate the insertion of a hollow sleeve 60 which is adapted to receive a cutter bit, such as a rotatable bit of the type shown in FIG. 1 and which is retained by any suitable conventional retainer. The bit can be suitable for cutting asphalt, concrete, dirt, rock, etc. The hollow sleeve 60 includes an enlarged head 62 and a shank 64 extending rearwardly therefrom along a longitudinal center axis 66 of the sleeve. Thus, at the junction between the head 62 and the shank 64 radial, a flange 68 is formed, i.e., a flange which extends substantially perpendicularly to the axis 66, in order to abut the block and terminate the insertion of the shank 64 into the hole 46.

The presence of the flange 68 is optional. Instead, there could be provided an abutment on the block that is engaged by a rear end of the shank to terminate the insertion.

Figure 5:
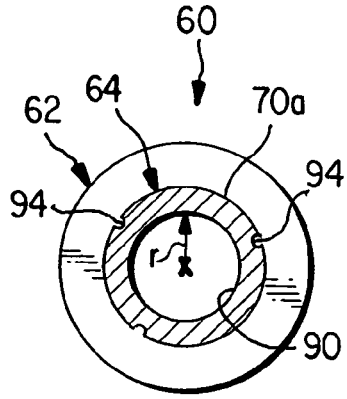
FIG. 5 is a cross-sectional view taken in FIG. 2.

The shank 64 includes an outer periphery having a radially stepped configuration that substantially conforms to that of the hole 46. That is, the outer surface of the shank includes a plurality of axially adjacent sections 70*a*, 70*b*, 70*c* that become successively smaller in cross-section in a direction away from the flange 68 and which create an interference fit with the hole. For example, the cross-sectional shape of the surface sections 70*a*-70*c* of the shank could be slightly larger than the corresponding crosssectional shape of the surface section of the hole 46 to achieve an interference fit preferably in the range of 0.003-0.004 inches. It will be appreciated that a cross-section taken through the shank 64 could be of circular configuration, as can be seen in FIG. 5.

Since the configuration of the outer peripheral surface of the shank generally corresponds to the surface of the hole 46, it will be appreciated that each surface section 70*a*-70*c* has longitudinally spaced front and rear ends, wherein a portion of each surface section 70*a*-70*c* situated between the front and rear ends thereof is spaced farther from the axis 66 than are the front and rear ends of the surface section.

For instance, and as noted previously, the midsection of each surface section is spaced farther from the radius than are the ends of the surface section, e.g., by 0.0005 inches. That means that as the surface sections 70*a*, 70*b*, 70*c* enter their respective surface sections 50*a*, 50*b*, 50*c*, there occurs a deformation of the shank and/or the hole surface by 0.0005 inches in addition to the deformation necessary to produce the interference fit of 0.003-0.004 inches. Once the surfaces have mated, the material of the block and/or shank will snap back by 0.0005 inches due to the inherent resiliency thereof, thereby providing an indication that the mating has occurred, as well as providing an extra retaining force for holding the sleeve within the hole 46. That is, after the material has snapped back, there remains the interference fit of 0.003-0.004 inches, but in order for the shank to be dislodged from the hole, not only is it necessary to overcome that normal interference fit of 0.003-0.004 inches, but also the additional deformation of 0.0005 inches must take place.

Furthermore, it will be appreciated that the overall surface area of the spherical surface sections 70*a*-70*c* and 50*a*-70*c* is greater than if those surfaces were cylindrically or conically shaped. The extra surface area provides added resistance to rotation of the sleeve once the sleeve has been installed.

Although the description has thus far recited that the surfaces 50*a*-50*c* are concave, and the surfaces 70*a*-70*c* are convex, but the reverse could be the case instead. In some embodiments, the surfaces 70*a*-70*c* have a barrel shape. As seen, for example, in FIG. 2, each of the barrel-shaped surfaces 70*a*-70*c* have a parallel top and bottom with a common axis and a side surface, i.e., surface 70*a*-70*c*, formed by a smooth curve.

Figure 4:
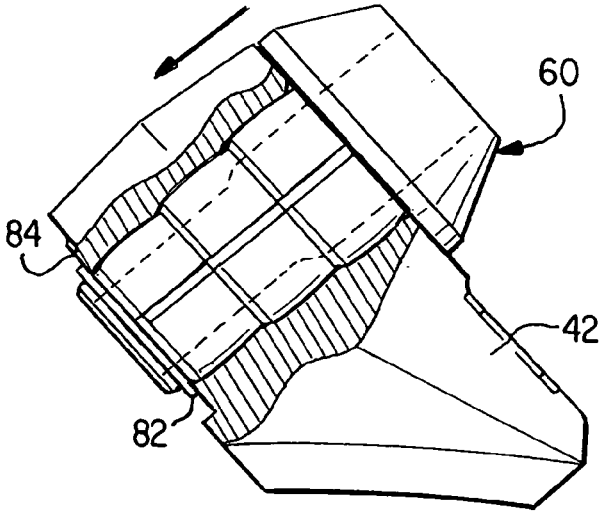
FIG. 4 is a view similar to FIG. 3 after the sleeve has been fully installed.

The rear end of the shank 64 is provided with an external annular recess 80 which will project slightly from the rear end of the hole once the sleeve has been fully installed, as can be seen in FIG. 4. That annular recess is shaped to receive a retainer, such as a split C-shaped ring clip 82 which will bear against a rear side 84 of the block 42 in a manner imparting a rearward force (i.e., leftward force in FIG. 4), to further retain the sleeve within the hole. That split ring clip 82 could be curved in the manner of a Belleville washer in order to provide a rearward bias to the sleeve, or the split ring 82 could be flat and a separate O-ring could be provided within the recess 80, between the split ring 82 and a rearward-most side of the recess 80 in order to bias the sleeve in a rearward (leftward) direction.

The internal surface 90 of the sleeve (see FIG. 5) is shaped to receive a conventional cutter bit (not shown) possibly of the type shown in FIG. 1.

In order to install the shank 64 within the hole 46 (or remove it from the hole), it is necessary to apply considerable longitudinal force to the sleeve, which is often performed by hydraulically powered equipment.

Figure 3:
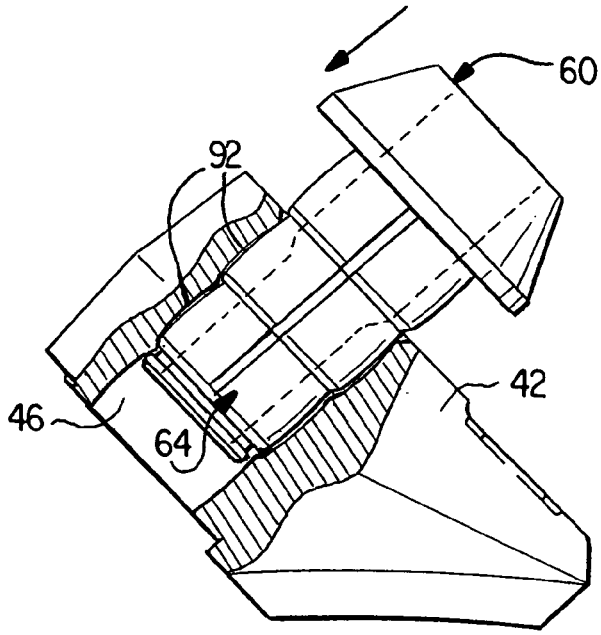
FIG. 3 is a view similar to FIG. 2 during an initial stage of sleeve installation.

Depicted in FIG. 3 is a state of the shank during an initial stage of insertion into the hole 46, i.e., when initial resistance is first encountered. That is, the surfaces 70*a*, 70*b*, 70*c* of the sleeve have made initial contact with the surfaces 50*a*, 50*b*, 50*c*, respectively, of the hole. In order to facilitate the insertion of the shank, it is common to provide lubricating oil on the shank. It will be appreciated that when the initial contact is made, small closed spaces 92 are formed between surface sections of the shank and surface sections of the hole. As the shank is forced farther into the hole, oil which is trapped in those spaces will become pressurized and oppose rearward movement of the shank.

It has heretofore been experienced that the pressurized oil in the spaces will tend to bias the shank out of the hole. During a cutting operation, as the cutter bits enter the material being cut, the force of the cutting action will push the sleeves rearwardly against the force of the pressurized oil. However, when the cutter bits emerge from the material being cut, the pressurized oil will force the shanks slightly from the hole. As this action repeats itself, the shanks will reciprocate within the hole, resulting in a wearing of the hole surfaces.

That problem is alleviated by the present invention because the frictional or interfering engagement between the surface sections of the shank and the surface sections of the hole are not continuous in the circumferential direction. Instead, small grooves 94 are formed in the outer periphery of the shank which extend in a front-to-rear direction, preferably parallel to the axis 66. Alternatively, the grooves could extend helically along the shank. Three such grooves 94 are depicted in the drawings at 120 degrees apart, but any suitable number of grooves could be employed. Those grooves 94 serve as discharge passages for pressurized oil, which will relieve any force that the oil would otherwise have tended to impart to the sleeve. The slots are shown in a somewhat exaggerated state in the figures. In that regard, a suitable groove could have a width in the circumferential direction of at least 0.010 inches, and a depth of at least 0.005 inches.

From the foregoing description, it will be appreciated that in order to install the sleeve into the block 42, it is necessary to insert the shank into the hole 46 until the initial resistance occurs, as shown in FIG. 3. Thereafter, a strong axial force is applied to the sleeve in the rearward direction, e.g., by a hydraulic mechanism, which causes the surface sections 70*a*-70*c* and/or 50*a*-50*c* to deform in the radial direction by distance X (which as noted previously, is preferably around 0.0005 inches), plus the normal interference of 0.003-0.004 inches.

Once the shank has fully entered the hole, the distance difference X is eliminated as the surfaces snap-back, thereby leaving the interference fit of 0.003-0.004 inches. In order to dislodge the sleeve, the additional deformation of X must re-occur. Thus, the sleeve is very reliably held in place.

The lubricating oil which has been applied to the shank to facilitate installation thereof will be free to flow out of the hole along the groove or grooves 94, rather than being pressurized in a manner opposing a full installation of the sleeve. Once the surface sections 70*a*-*c* are fully inserted into the respective surface sections 50*a*-50*c*, the retainer 82 is inserted into the slot 80 of the shank in order to further bias the shank rearwardly.

It will be appreciated that the present invention provides a more effective interference fit of the shank within the hole to more effectively resist premature longitudinal dislodgement of the sleeve, as well as to resist rotation of the sleeve within the hole.

It is also noted that the sleeve 60 is securely held in place due to the provision of three surface sections i.e., the front, rear, and intermediate surface sections 50*a*, 50*c*, 50*b*, respectively as compared to the two surface sections provided in the prior art. Moreover, the longitudinal length L of each surface section is substantially equal to the longitudinal distance L' from the front end 50*a'* of the front surface section 50*a* to the rear end 50*c''* of the rear surface section 50*c*. Thus, even if the surface sections were of cylindrical shape instead of spherical shape, a more secure interference fit would occur than occurs in the prior art.

Figure 7:
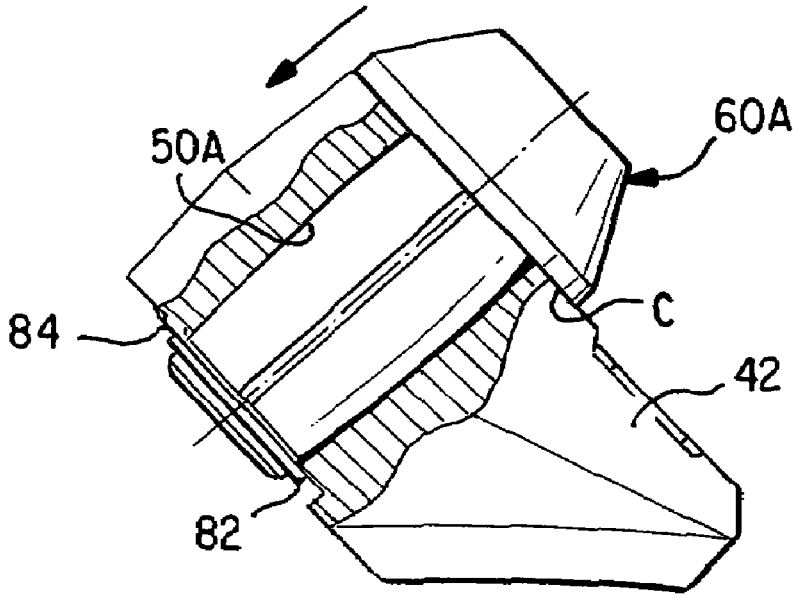
FIG. 7 is a longitudinal sectional view through a first alternative embodiment of the invention.

It has been found that the feature of the invention wherein a portion of the outer surface of the shank (or hole) located between the front and rear ends of that surface is spaced farther from, or closer to, the axis than are the front and rear ends, provides a securement of the shank that is so effective, it might require only a single surface section as shown in FIG. 7 wherein the hole 50A and the shank of the sleeve 60A each have only one interference-forming surface section, which surface section would be of spherical, elliptical, etc., curvature.

Figure 8:
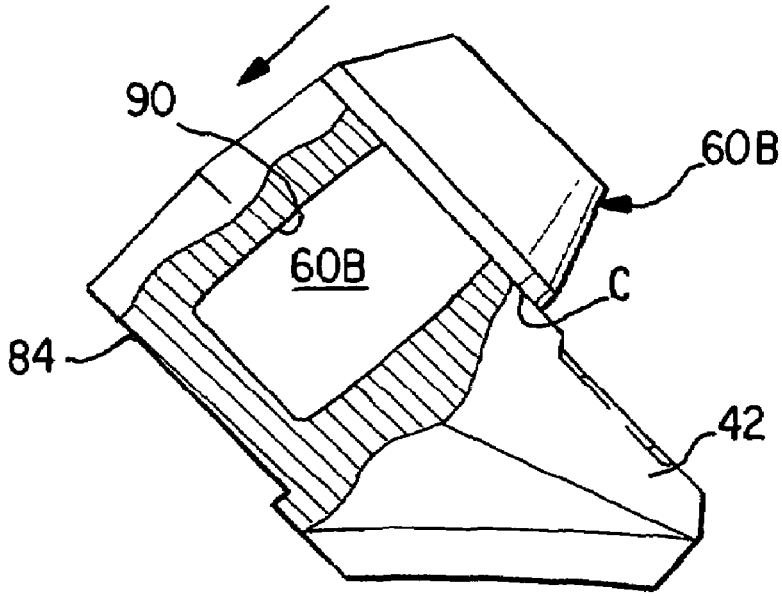
FIG. 8 is a longitudinal sectional view through a second alternative embodiment of the invention.

Moreover, such an expedient may not even require the need for a separate sleeve fastener 82, as demonstrated by the arrangement shown in FIG. 8 wherein the shank of the sleeve 60B is inserted into a blind hole 90, rather than into a through-hole. Such an arrangement might be best used in a system where there is insufficient room at the back of the block 42B to provide a fastener 82.

As an alternative to the embodiments shown in FIGS. 7 and 8, the concave/convex relationships could be reversed, as noted earlier. That is, the shank of the sleeve could be concave, and the surface of the receiving hole 50A or 90 would be convex.

The sleeve could have a flange or collar C that engages the holder block to limit the extent of insertion into the hole, as shown in FIGS. 7 and 8.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A holder block for a cutting bit adapted to receive a hollow sleeve, comprising a body having a hole formed therein and defining a longitudinal center axis, the hole including at least one non-continuous circumferential surface section extending between longitudinally spaced front and rear ends, wherein a portion of the at least one surface section situated between the front and rear ends is spaced farther from the axis than are the front and rear ends and has a barrel shape and wherein the at least one non-continuous circumferential surface section has a generally front-to-rear extending groove formed therein from the front end to the rear end.

2. A holder block for a cutting bit adapted to receive a hollow sleeve, comprising a body having a hole formed therein and defining a longitudinal center axis, the hole including at least two surface sections which each include sets of longitudinally spaced front and rear ends, wherein a portion of the first surface section situated between a first set of front and rear ends is spaced radially farther from the longitudinal center axis than are the first set of front and rear ends and wherein a portion of the second surface section situated between a second set of front and rear ends is spaced radially farther from the longitudinal center axis than is the first surface section, wherein at least one of the first surface section and the second surface section has a generally front-to-rear extending groove formed therein from the front end to the rear end.

3. The holder block for a cutting bit of claim 2, wherein the first surface section has a substantially spherical curvature, has a substantially parabolic curvature, or has a substantially elliptical curvature.

4. The holder block for a cutting bit of claim 2, wherein at least one of the first surface section and the second surface section has a barrel-shaped curvature.

5. The holder block for a cutting bit of claim 2, wherein the second surface section has a substantially spherical curvature, has a substantially parabolic curvature, or has a substantially elliptical curvature.

6. The holder block for a cutting bit of claim 3, wherein the second surface section has a substantially spherical curvature, has a substantially parabolic curvature, or has a substantially elliptical curvature.

7. The holder block for a cutting bit of claim 2, wherein both the first surface section and the second surface section have a generally front-to-rear extending groove formed therein from the front end to the rear end.

8. A combination, comprising:

a holder block for a cutting bit; and a hollow sleeve, wherein the holder block includes a body having a hole formed therein and defining a longitudinal center axis, the hole including at least one surface section which includes longitudinally spaced front and rear ends, wherein a portion of the at least one surface section situated between the front and rear ends is spaced radially farther from the longitudinal center axis than are the front and rear ends, wherein the hollow sleeve includes a shank including a front end and defining a longitudinal axis, the shank including an outer periphery having a radially stepped configuration wherein an outer surface of the shank includes a plurality of axially adjacent surface sections that become successively smaller in cross-section in a rearward direction away from the front end, each surface section having a generally front-to-rear extending groove formed therein, and a center through-hole extending axially through the shank, wherein each surface section has a substantially spherical curvature, has a substantially parabolic curvature, or has a substantially elliptical curvature, and wherein the holder block is adapted to receive the hollow sleeve.

9. The combination of claim 8, wherein a rearward-most portion of the shank includes an external annular recess.

10. The combination of claim 9, comprising a retainer located in the external annular recess and bearing against the block holder.

11. The combination of claim 8, wherein the sleeve consists of three surface sections.

12. The combination of claim 8, wherein prior to mating of the shank with the hole, when the shank and the hole are in a relaxed state, the cross-sectional size of at least a portion of the at least one surface section of the shank is greater than the cross-sectional size of a place on the respective surface section of the hole which is to be contacted by such portion, wherein an interference fit is established at such portion when the shank is mated with the hole.

13. The combination of claim 8, wherein the hole consists of one surface section extending from the front end to the rear end, the one surface section defining an interference-forming surface section.

14. The combination of claim 13, wherein the interference-forming surface section has a spherical or elliptical curvature.

15. The combination of claim 13, wherein the interference-forming surface section is barrel-shaped.

16. The combination of claim 8, wherein the at least one surface section is a circumferential surface section.

17. A holder block for a cutting bit adapted to receive a hollow sleeve, comprising a body having a hole formed therein and defining a longitudinal center axis, the hole consisting of one non-continuous circumferential surface section which includes longitudinally spaced front and rear ends, wherein a portion of the one surface section situated between the front and rear ends is spaced radially farther from the longitudinal center axis than are the front and rear ends.

18. The holder block for a cutting bit of claim 17, wherein the one surface section has a substantially spherical curvature, has a substantially parabolic curvature, or has a substantially elliptical curvature.

19. The holder block for a cutting bit of claim 17, wherein the one surface section has a generally front-to-rear extending groove formed therein from the front end to the rear end.

20. A combination, comprising:

a holder block for a cutting bit; and a hollow sleeve, wherein the holder block includes a body having a hole formed therein and defining a longitudinal center axis, the hole consisting of one surface section which includes longitudinally spaced front and rear ends, wherein a portion of the one surface section situated between the front and rear ends is spaced radially farther from the longitudinal center axis than are the front and rear ends, wherein the hollow sleeve includes a shank including a front end and defining a longitudinal axis, the shank including an outer periphery and a generally front-to-rear extending groove formed therein, and a center through-hole extending axially through the shank, wherein the one surface section of the holder block and the outer periphery of the shank have correlating profiles, wherein the profile is a substantially spherical curvature, a substantially parabolic curvature, or a substantially elliptical curvature, and wherein the holder block is adapted to receive the hollow sleeve.

21. The combination of claim 20, wherein a rearward-most portion of the shank includes an external annular recess.

22. The combination of claim 21, comprising a retainer located in the external annular recess and bearing against the block holder.

23. The combination of claim 20, wherein prior to mating of the shank with the hole, when the shank and the hole are in a relaxed state, the cross-sectional size of at least a portion of the outer periphery of the shank is greater than the cross-sectional size of a place on the respective surface section of the hole which is to be contacted by such portion, wherein an interference fit is established at such portion when the shank is mated with the hole.

24. The combination of claim 20, wherein the at least one surface section is a circumferential surface section.

25. A combination, comprising:

a holder block for a cutting bit; and a hollow sleeve, wherein the holder block includes a body having a hole formed therein and defining a longitudinal center axis, the hole consisting of one surface section which includes longitudinally spaced front and rear ends, wherein a portion of the one surface section situated between the front and rear ends is spaced radially farther from the longitudinal center axis than are the front and rear ends, wherein the hollow sleeve includes a shank including a front end and defining a longitudinal axis, the shank including an outer periphery having a profile that correlates to the one surface section of the hole of the holder block and including a generally front-to-rear extending groove formed in the outer periphery, and a center through-hole extending axially through the shank, wherein the profile is a barrel-shaped, and wherein the holder block is adapted to receive the hollow sleeve.

26. The combination of claim 25, wherein prior to mating of the shank with the hole, when the shank and the hole are in a relaxed state, the cross-sectional size of at least a portion of the outer periphery of the shank is greater than the cross-sectional size of a place on the respective surface section of the hole which is to be contacted by such portion, wherein an interference fit is established at such portion when the shank is mated with the hole.

27. The combination of claim 25, wherein a rearward-most portion of the shank includes an external annular recess.

28. The combination of claim 25, wherein the one surface section is a circumferential surface section.

* * * * *